US010595609B2

(12) United States Patent
Tuttle

(10) Patent No.: US 10,595,609 B2
(45) Date of Patent: Mar. 24, 2020

(54) DECORATIVE HAIR ACCESSORY, AND METHOD OF USING SAME

(71) Applicant: Tiffany Z. Tuttle, Farmington Hills, MI (US)

(72) Inventor: Tiffany Z. Tuttle, Farmington Hills, MI (US)

( * ) Notice: Subject to any disclaimer, the term of this patent is extended or adjusted under 35 U.S.C. 154(b) by 448 days.

(21) Appl. No.: 15/587,804

(22) Filed: May 5, 2017

(65) Prior Publication Data

US 2017/0325565 A1 Nov. 16, 2017

Related U.S. Application Data

(60) Provisional application No. 62/334,716, filed on May 11, 2016.

(51) Int. Cl.

| | |
|---|---|
| ***A45D 8/00*** | (2006.01) |
| ***A45D 8/34*** | (2006.01) |
| ***A45D 8/36*** | (2006.01) |

(52) U.S. Cl.

CPC ..... *A45D 8/00* (2013.01); *A45D 8/34* (2013.01); *A45D 8/36* (2013.01); *A45D 2008/004* (2013.01)

(58) Field of Classification Search

CPC ..... A45D 8/00; A45D 2008/004; A45D 8/14; A45D 8/20

See application file for complete search history.

(56) References Cited

U.S. PATENT DOCUMENTS

| | | | | |
|---|---|---|---|---|
| 2,796,069 A | | 6/1957 | Mooney, Jr. | |
| 3,422,565 A | * | 1/1969 | Dreyfuss | A63H 33/103 446/102 |
| 3,746,016 A | | 7/1973 | Goodman | |
| 3,998,003 A | * | 12/1976 | Rosenbaum | A63H 33/102 446/119 |
| 4,404,240 A | * | 9/1983 | Varela | A63H 33/40 403/172 |
| 4,583,956 A | * | 4/1986 | Nelson | A63H 33/103 446/119 |
| 4,614,502 A | * | 9/1986 | Nelson | A63F 9/0876 135/121 |
| 5,430,989 A | * | 7/1995 | Jones | E04B 1/1903 403/171 |

(Continued)

*Primary Examiner* — Nicholas D Lucchesi

(74) *Attorney, Agent, or Firm* — Carrier Blackman & Associates, P.C.; William D. Blackman; Joseph P. Carrier

(57) ABSTRACT

A decorative hair accessory, for placement covering a grouping of a user's hair, includes a hollow cage-like receptacle formed from interconnected tubular segments. The receptacle includes a proximal frame portion having a main opening therein to receive the hair bundle, and a distal cage body attached to the frame portion. The frame portion includes at least three segments interconnected by an elastic filament. The frame portion also has a plurality of junction points where adjacent segments are connected. The frame portion can be temporarily stretched out to allow a user to place a hair bundle therein. The cage body includes a plurality of primary distal tubular segments, at least one of which is connected to, and extends outwardly away from the frame portion at each of the junction points. Ends of the primary distal tubular segments are joined together to define a distal apex of the cage body.

7 Claims, 6 Drawing Sheets

(56) References Cited

U.S. PATENT DOCUMENTS

| | | | | |
|---|---|---|---|---|
| 6,679,644 | B1 * | 1/2004 | Heller | A63H 33/10 135/127 |
| 7,331,353 | B2 | 2/2008 | Harvie | |
| 7,631,647 | B2 | 12/2009 | Sonstegard | |
| 7,900,646 | B2 * | 3/2011 | Miller | E04H 15/44 135/120.3 |
| 8,318,272 | B1 * | 11/2012 | Maltar | B31D 99/00 428/34.2 |
| 9,022,043 | B1 | 5/2015 | Lujan-Puckett et al. | |
| 2003/0182874 | A1 * | 10/2003 | Barber | A47B 13/02 52/81.1 |
| 2004/0194411 | A1 * | 10/2004 | Olsson | E04B 1/19 52/633 |
| 2005/0245960 | A1 * | 11/2005 | Grundeman | A61B 17/02 606/192 |
| 2006/0174907 | A1 | 8/2006 | Morris et al. | |
| 2013/0095901 | A1 * | 4/2013 | Houlis | A63F 9/088 463/9 |
| 2014/0048094 | A1 * | 2/2014 | Carriedo | A45D 8/00 132/210 |

* cited by examiner

Typical Section
A-A

DECORATIVE HAIR ACCESSORY, AND METHOD OF USING SAME

CROSS-REFERENCE TO RELATED APPLICATIONS

The present application claims priority under 35 USC § 119(e) from U.S. Provisional Patent Application No. 62/334,716, filed 11 May 2016, the entire disclosure of which is incorporated herein by reference.

BACKGROUND OF THE INVENTION

1. Field of the Invention

The present invention relates to a decorative hair accessory, and to a method of applying the hair accessory to a selected portion or grouping of a user's hair.

2. Description of the Background Art

The world of fashion is complex. It is constantly evolving, while at the same time, tends to be somewhat cyclical. Trends come and go, styles vary by age, culture, and geographic location, and in our modern world, the hairstyling and fashion industry is constantly looking for something new, unique and fashion-forward.

Hair-confining bags known as "snoods" have been known for many years. Wikipedia defines a snood as a type of female headgear designed to hold the hair in a cloth or yarn bag.

A number of different hair accessories, for decoratively confining and/or controlling hair have previously been patented.

Examples of some of the known hair accessories include those described in Mooney, Jr., U.S. Pat. No. 2,796,069, Goodman, U.S. Pat. No. 3,746,016, Harvie, U.S. Pat. No. 7,331,353, Sonstegard, U.S. Pat. No. 7,631,647, Lujan-Puckett, U.S. Pat. No. 9,022,043, and Morris, U S Published application 2006-0174907.

Although the known hair accessories are usable for their intended purposes, a need still exists in the fashion industry for a new decorative hair accessory.

SUMMARY OF THE INVENTION

A decorative hair accessory according to a first illustrative embodiment of the invention includes a hollow cage-like receptacle, for placement on a head of a user and decoratively receiving a bundle of hair therein. The receptacle is formed from a plurality of interconnected tubular segments, and includes a proximal frame portion with a main opening formed therein to receive the hair bundle therethrough, and a distal cage body attached to the frame portion.

The frame portion includes at least three tubular segments interconnected by a resiliently stretchable elastic filament. The frame portion also has a plurality of junction points where end portions of adjacent segments are connected together.

The cage body includes a plurality of primary distal tubular segments, at least one of which is connected to, and extends outwardly away from the frame portion at each of the junction points, respectively. Distal ends of the primary distal tubular segments are joined together to define a distal apex of the cage body.

Accordingly, it is an object of the present invention to provide a decorative hair accessory for placement covering a grouping of a user's hair, such as a bun, braided section or ponytail.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF ILLUSTRATIVE EMBODIMENTS

First Embodiment

Referring now to FIGS. 1-7 of the drawings, a decorative hair accessory according to a first illustrative embodiment of the invention is shown generally at 20. The hair accessory 20 defines a hollow cage-like receptacle 22, for receiving a selected hair bundle HB, such as a pre-formed bun, braided hair section or ponytail, on a head H of a user (FIGS. 6-7) and for placement decoratively covering part or all of the hair bundle HB for a time period selected by the user, such as during a working or school day, on a special occasion, or for leisure. The hair accessory 20 according to the first embodiment is formed generally in the shape of a tetrahedron, or a 3-sided pyramid having a triangular base.

Figure 1:
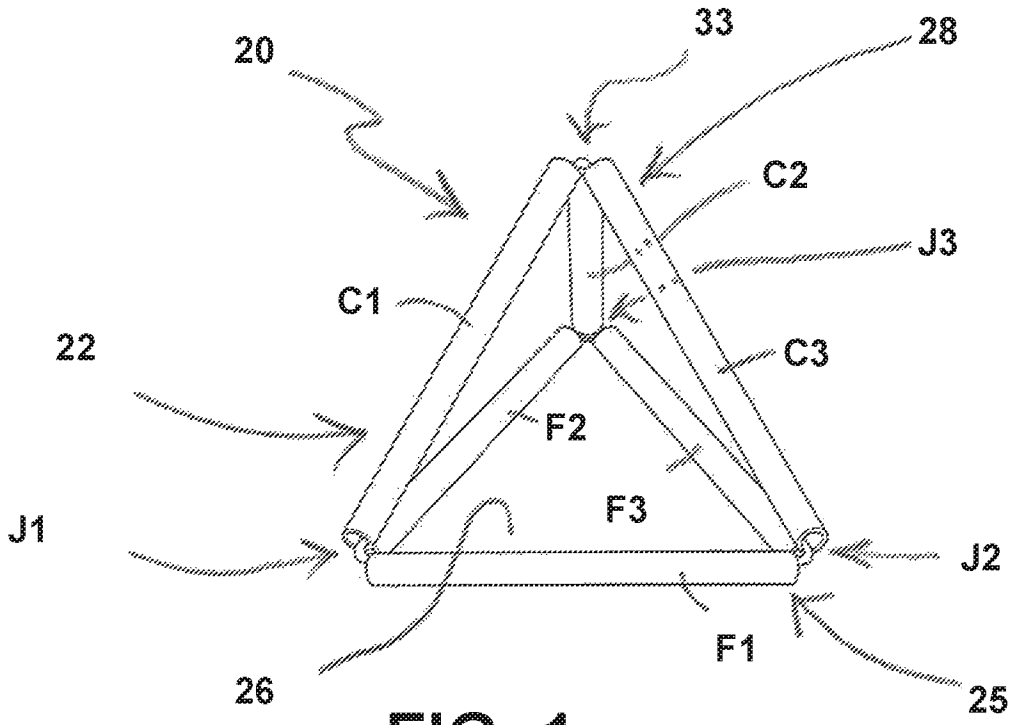
FIG. 1 is a first perspective view of a decorative hair accessory according to a first illustrative embodiment of the present invention, taken form a first vantage point.

The receptacle 22 is formed from a plurality of interconnected tubular segments, such as those shown in FIG. 1 as F1-F3 and C1-C3. The tubular segments F1-F3 and C1-C3 are all substantially identical to one another, and are formed as hollow tubes, which may be formed of metal, plastic or other suitable material.

The receptacle 22 includes a proximal frame portion 25 (formed by three interconnected segments F1-F3 in the embodiment of FIG. 1) with a main opening 26 formed therein to receive the hair bundle HB. The receptacle 22 further includes a distal cage body 28 (formed by three interconnected segments C1, C2 and C3 in the embodiment of FIG. 1), and the cage body is attached to the frame portion 25 in a manner to be described below.

The frame portion 25 includes at least three of the tubular segments F1, F2 and F3, interconnected by a resiliently stretchable elastic filament 30 (FIG. 3), which is threaded through each of the segments of the frame portion and fastened to itself to form a loop. The material used for the stretchable elastic filament 30 should be relatively durable, and may be similar to the stretchable fabric-coated elastic material used to make commercially available hair ties. The stretchable elastic filament 30 is significantly smaller in diameter than the hollow segment S6 which surrounds it, as shown in the cross-sectional view of FIG. 6.

The frame portion 25 also has a plurality of junction points J1, J2, and J3, where end portions of adjacent segments such as F1 and F2, or F2 and F3 are connected together.

The cage body 28 includes a plurality of primary distal tubular cage segments C1, C2 and C3, at least one of which is connected to, and extends outwardly away from the frame portion 25 at each of the junction points J1, J2, and J3, respectively. In addition, distal ends of the primary distal tubular segments C1, C2 and C3 are joined together to define a distal apex 33 of the cage body 28, which is also a fourth junction point.

The material used to join the segments C1, C2 and C3 of the cage body to one another and to the frame portion 25 may be the same as, or different from the stretchable elastic material 30 used to join the segments F1, F2 and F3 of the frame portion together. In one embodiment, the material used to join the segments of the cage body 28 together may be different from the stretchable elastic material 30, and may be a flexible but relatively non-stretchable plastic filament similar to a relatively heavy gauge monofilament fishing line. The material used to join the segments C1, C2 and C3 of the cage body 28 to one another and to the frame portion 25 is connected to the stretchable elastic material 30 at each of the junction points J1, J2 and J3, thereby interconnecting the cage body 28 and the frame portion 25.

Figure 5:
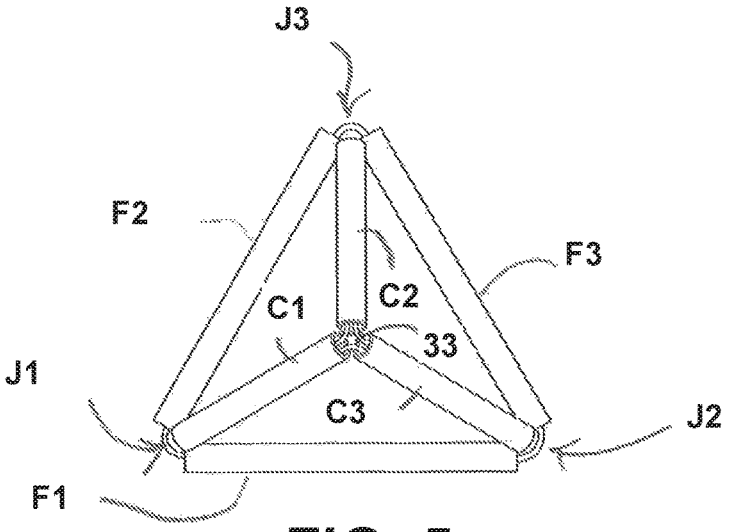
FIG. 5 is a top plan view of the decorative hair accessory of FIGS. 1-2.
Figure 2:
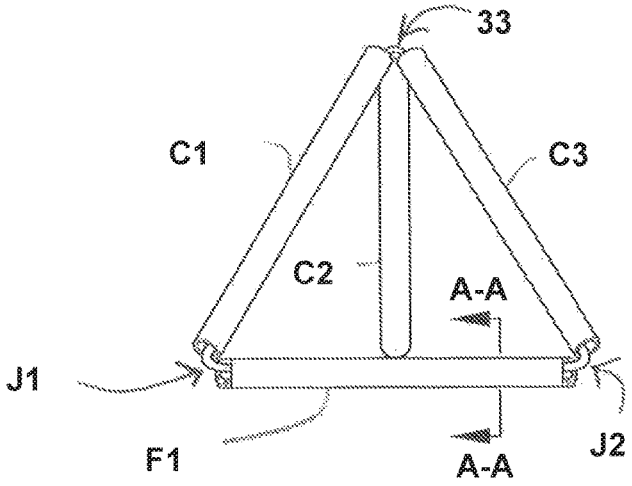
FIG. 2 is a second perspective view of the decorative hair accessory of FIG. 1, taken from a second vantage point which is slightly lower than the first vantage point.
Figure 4:
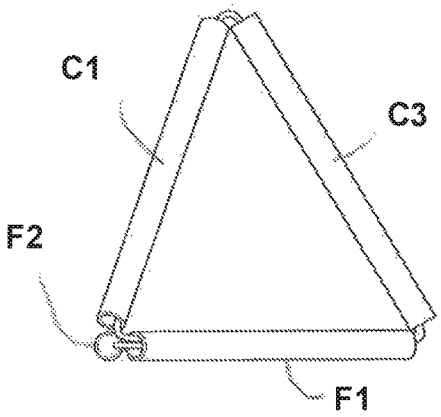
FIG. 4 is a third perspective view of the decorative hair accessory of FIGS. 1-2, taken from a second vantage point which is slightly to the left of the second vantage point.
Figure 3:
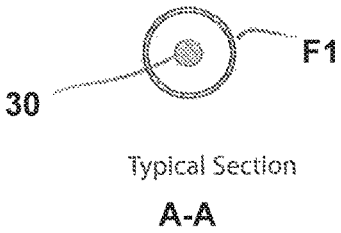
FIG. 3 is a cross-sectional view of one segment of the hair accessory of FIG. 1, taken along the line A-A in FIG. 2.

Referring now to FIG. 5, it will be seen that the hair bundle HB, which may be a bun, braided hair section or ponytail, is first formed by the user. Then, the user manipulates the segments F1, F2 and F3 of the frame portion 25 to stretch these segments apart from one another. The user then moves the hair accessory 20 towards the user's head H to receive the hair bundle HB through the opening 26 of the frame portion 25, and places the stretched-apart frame portion into position surrounding the base of the hair bundle HB.

Figure 6:
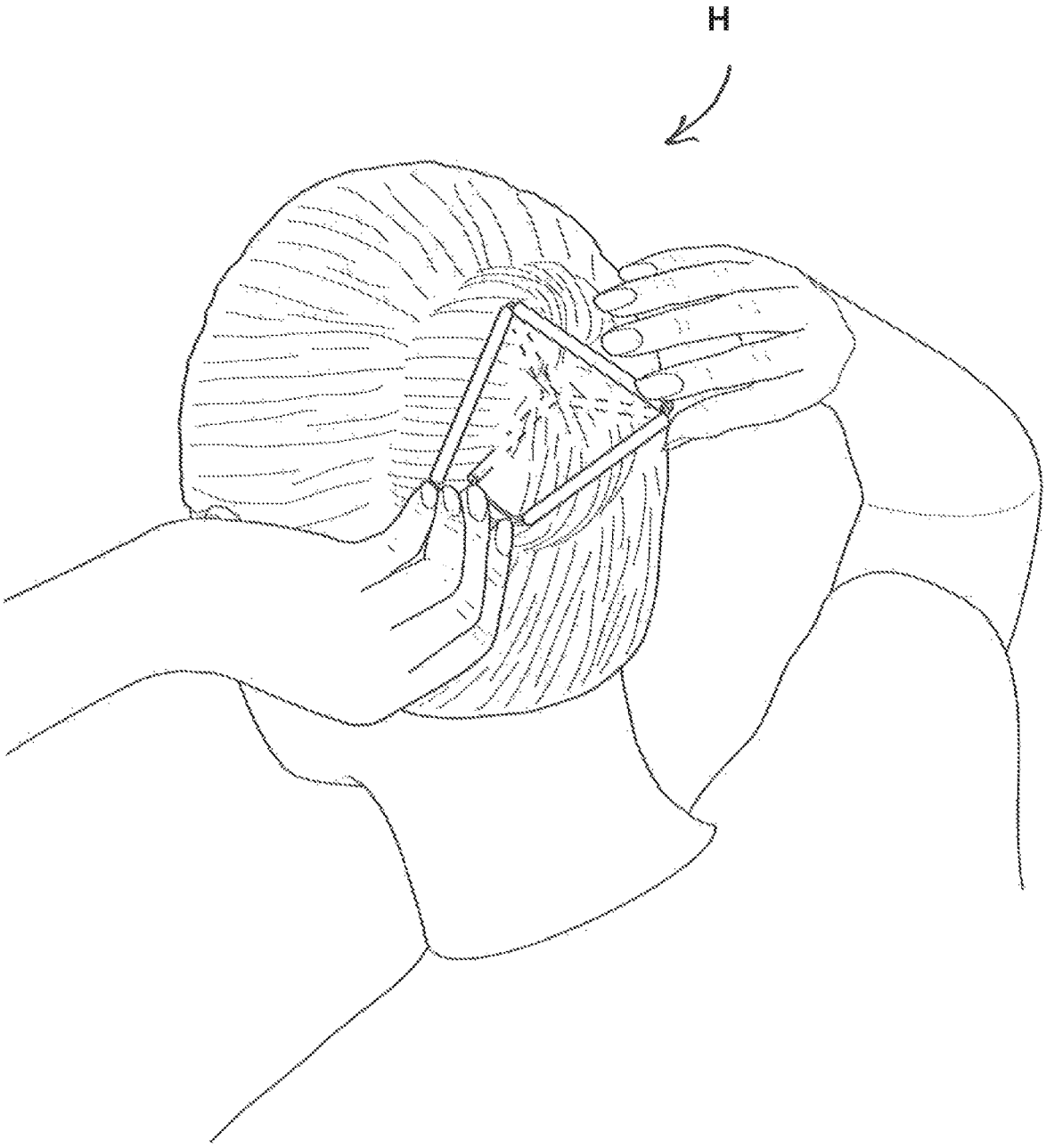
FIG. 6 is an environmental perspective view showing a user installing the decorative hair accessory of FIGS. 1-2 over a pre-formed hair bun.
Figure 7:
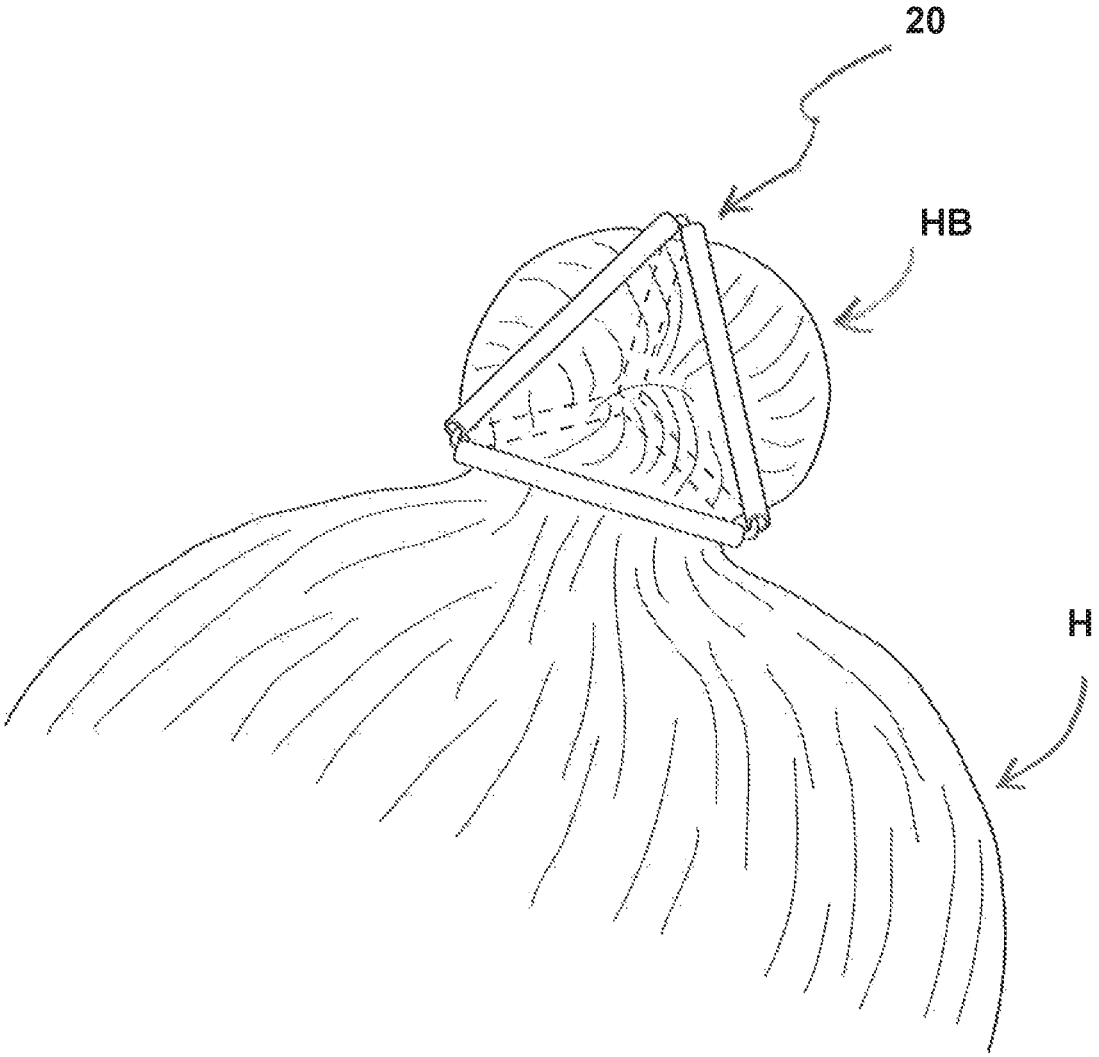
FIG. 7 is another environmental perspective view showing the decorative hair accessory of FIGS. 1-2 installed and in position covering the user's hair bun.

Once the hair bundle HB is suitably received inside of the cage body 28, the frame portion is released, the stretchable elastic material 30 retracts the frame portion to its normal orientation with the segments F1, F2 and F3 touching one another at the junction points J1, J2 and J3, and the hair accessory 20 is then installed on the head H of the user, and decoratively contains and surrounds the hair bundle HB, as shown in FIG. 6.

Second Embodiment

Referring now to FIGS. 8-12 of the drawings, a decorative hair accessory according to a second illustrative embodiment of the invention is shown generally at 120. The hair accessory 120 defines a hollow cage-like receptacle 122, for receiving a selected hair bundle HB, such as a pre-formed bun or ponytail, on a head H of a user (FIGS. 6-7) and for placement decoratively covering the hair bundle HB for a time period selected by the user. In the drawings, the hair bundle HB is shown as a bun. The hair accessory 120 according to the second embodiment is formed generally in the shape of four linked tetrahedra, with a central part of the accessory forming a 4-sided pyramid having a square base.

Figure 8:
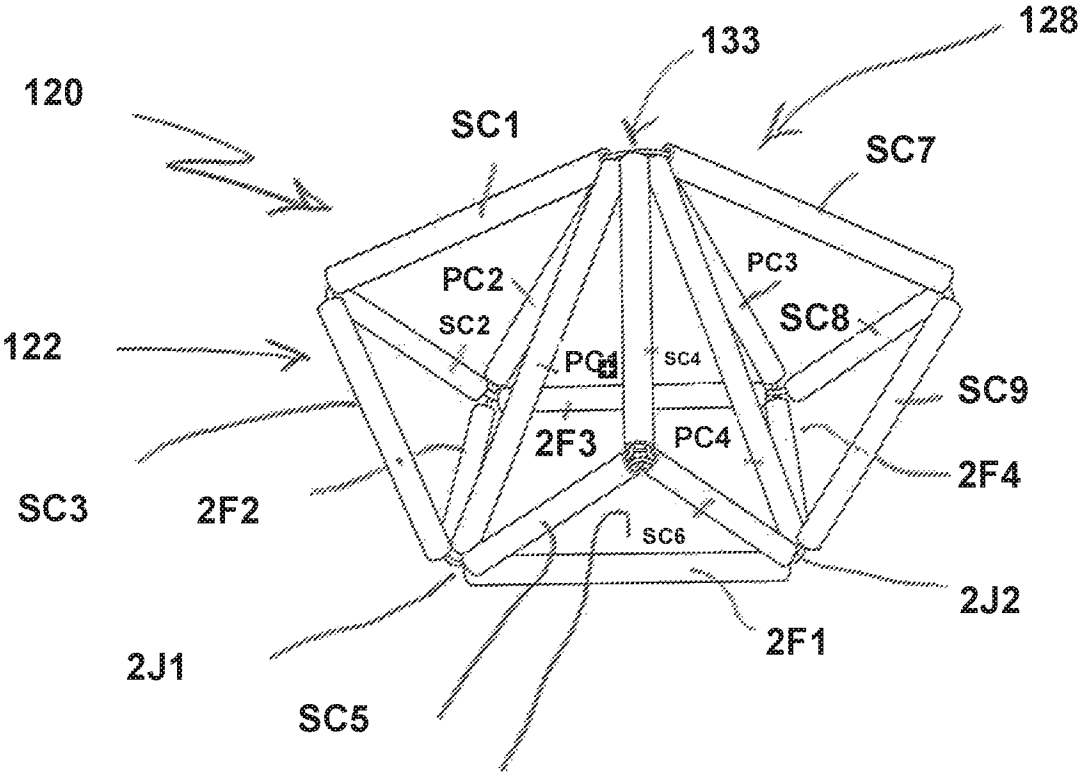
FIG. 8 is a first perspective view of a decorative hair accessory according to a second illustrative embodiment of the present invention, taken form a first vantage point.
Figure 11:
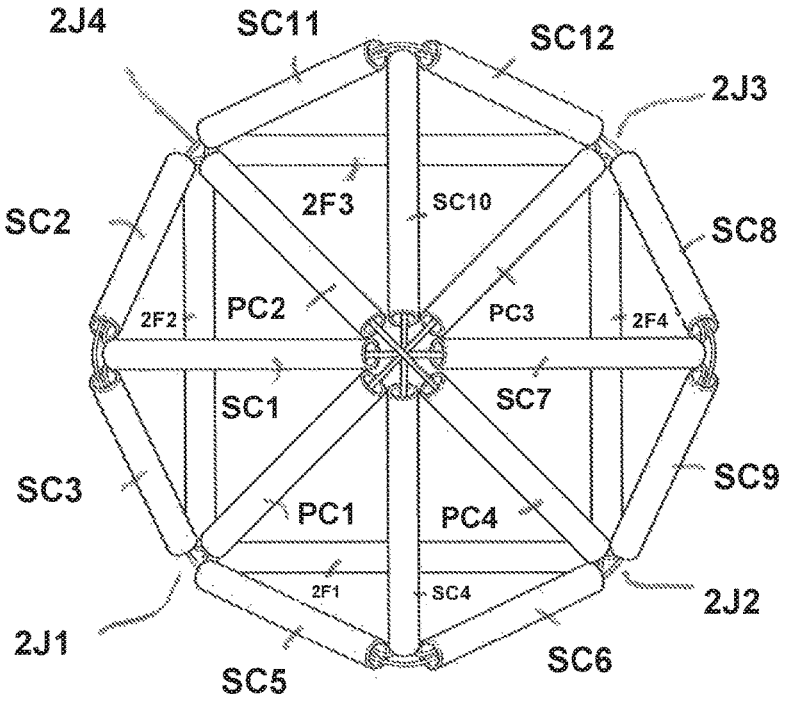
FIG. 11 is a top plan view of the decorative hair accessory of FIGS. 8-9.

The receptacle 122 is formed from a plurality of interconnected tubular segments, such as those shown in FIG. 8 as 2F1-2F4, PC1-PC4 and SC1-SC9. All of the tubular segments making up the receptacle 122 are formed from hollow tubes, and may be formed of metal, plastic or other suitable material. The receptacle 122 includes a proximal frame portion 125 (formed by four interconnected segments 2F1-2F4 in the embodiment of FIG. 8) with a main opening 126 formed centrally therein to receive the hair bundle HB therethrough. The receptacle 122 further includes a distal cage body 128 (formed by four interconnected segments PC1-PC4 in the embodiment of FIG. 8), and the cage body is attached to the frame portion 125.

The frame portion 125 includes four tubular segments 2F1 through 2F4 cooperating to define a square shape, and interconnected by a resiliently stretchable elastic filament 130. The material used for the stretchable elastic filament 130 is the same as that previously described for the stretchable elastic filament 30. The stretchable elastic filament 130 extends through each of the tubular segments PC1-PC4 of the frame portion 125. The stretchable elastic filament 130 is formed into a loop having the ends thereof tied together or otherwise connected. The frame portion 125 also has a plurality of junction points 2J1, 2J2, 2J3 and 2J4, where end portions of adjacent segments are connected together.

The cage body 128 includes a plurality of primary distal tubular cage segments PC1, PC2, PC3 and PC4, at least one of which is connected to, and extends outwardly away from the frame portion 125 at each of the junction points 2J1, 2J2, 2J3 and 2J4, respectively. In addition, distal ends of the primary distal tubular segments PC1-PC4 are joined together to define a distal apex 133 of the cage body 128.

Figure 9:
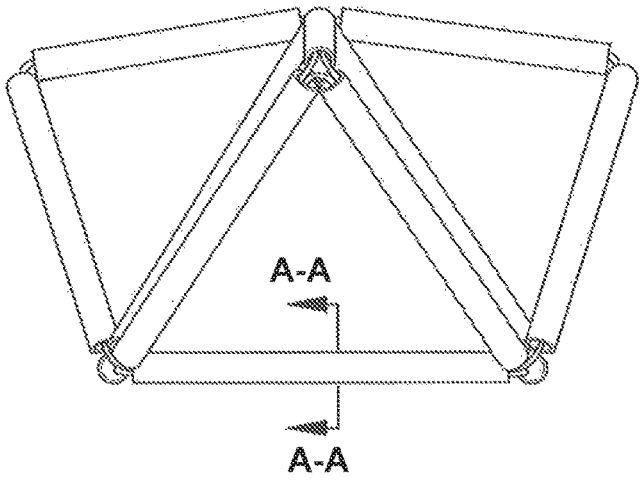
FIG. 9 is a second perspective view of the decorative hair accessory of FIG. 8, taken from a second vantage point, which is slightly lower than the first vantage point.
Figure 10:
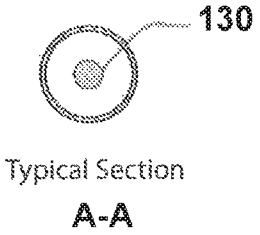
FIG. 10 is a cross-sectional view of one segment of the hair accessory of FIGS. 8-9, taken along the line A-A in FIG. 9.

In this second embodiment, the cage body also includes twelve secondary distal tubular segments SC1 through SC 12, as seen best in FIGS. 8-9.

The material used to join the segments of the cage body 128 together, and to the frame portion 125 may be the same as, or different from the stretchable elastic material 130. In one embodiment, the material used to join the segments of the cage body 128 together may be similar to a relatively heavy gauge monofilament fishing line.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the appended claims, are intended to be within the scope and spirit of the present invention.

What is claimed is:

1. A decorative hair accessory comprising a hollow cage receptacle for placement on a head of a user and for decoratively receiving a bundle of hair therein, the cage receptacle being formed from a plurality of interconnected tubular segments and comprising a proximal frame portion with a main opening formed therein, and a distal cage body attached to the frame portion;

wherein the frame portion comprises at least three of the tubular segments interconnected by a single resiliently stretchable elastic filament which is threaded through each of the segments of the frame portion and fastened to itself, and the frame portion has a plurality of junction points where end portions of adjacent segments are connected together, and wherein the cage body comprises a plurality of primary distal tubular segments, in which at least one of the primary distal tubular segments is connected to the frame portion at each of the junction points and extends outwardly away from the frame portion, and distal ends of the primary distal tubular segments are joined together to define a distal apex of the cage body.

2. The decorative hair accessory of claim 1, wherein the tubular segments are formed of a metal material.

3. The decorative hair accessory of claim 1, wherein the tubular segments are formed of a plastic material.

4. The decorative hair accessory of claim 1, wherein the frame portion is formed from exactly three tubular segments.

5. The decorative hair accessory of claim 1, wherein each of the tubular segments extends substantially in a straight line throughout its length.

6. A method of using a decorative hair accessory comprising a hollow cage receptacle formed from a plurality of interconnected tubular segments and comprising a proximal frame portion with a main opening formed therein, and a distal cage body attached to the frame portion;

wherein the frame portion comprises at least three of the tubular segments interconnected by a resiliently stretchable elastic filament, and the frame portion has a plurality of junction points where end portions of adjacent segments are connected together, and wherein the cage body comprises a plurality of primary distal tubular segments, in which at least one of the primary distal tubular segments is connected to the frame portion at each of the junction points and extends outwardly away from the frame portion, and distal ends of the primary distal tubular segments are joined together to define a distal apex of the cage body, said method comprising the steps of:

a) stretching the segments of the frame portion apart from one another to enlarge the opening of the frame portion;

b) moving the hair accessory toward a user's head to receive a hair bundle through the opening of the frame portion, and placing the stretched-apart frame portion into position surrounding a base of the hair bundle; and c) releasing the frame portion and leaving the hair accessory in place on the user's head.

7. The method of claim 6, wherein the hair bundle is either a bun, a braided hair section or a ponytail.

* * * * *